US006701562B2

(12) United States Patent
Burke et al.

(10) Patent No.: US 6,701,562 B2
(45) Date of Patent: Mar. 9, 2004

(54) SPAN LOCK WITH CENTERING GUIDE

(75) Inventors: Daniel Burke, Chicago, IL (US); Emilie Becq-Giraudon, Chicago, IL (US)

(73) Assignees: City of Chicago, Chicago, IL (US); Steward Machine Co., Inc., Birmingham, AL (US)

( * ) Notice: Subject to any disclaimer, the term of this patent is extended or adjusted under 35 U.S.C. 154(b) by 0 days.

(21) Appl. No.: 10/222,408

(22) Filed: Aug. 16, 2002

(65) Prior Publication Data

US 2003/0106172 A1 Jun. 12, 2003

Related U.S. Application Data

(60) Provisional application No. 60/367,997, filed on Mar. 26, 2002, and provisional application No. 60/341,509, filed on Dec. 12, 2001.

(51) Int. Cl.[7] ..... G01D 15/00

(52) U.S. Cl. ..... 14/46; 14/41; 14/31; 14/35

(58) Field of Search ..... 14/35, 41, 46

(56) References Cited

U.S. PATENT DOCUMENTS

| | | | | | |
|---|---|---|---|---|---|
| 141,911 | A | * | 8/1873 | Atkins | 14/71.1 |
| 685,768 | A | | 11/1901 | Keller | |
| 689,856 | A | | 12/1901 | Cummings | |
| 1,659,250 | A | * | 2/1928 | Erdal | 14/41 |
| 2,085,613 | A | * | 6/1937 | Stiles | 14/35 |
| 2,610,341 | A | | 9/1952 | Gilbert | |
| 5,327,605 | A | | 7/1994 | Cragg | |
| 6,588,041 | B1 | * | 7/2003 | Cragg et al. | 14/46 |

* cited by examiner

*Primary Examiner*—Robert E. Pezzuto
*Assistant Examiner*—Raymond W. Addie
(74) *Attorney, Agent, or Firm*—Brinks Hofer Gilson & Lione

(57) ABSTRACT

A span lock system for a double-leaf drawbridge. A guide housing mounted at the tip of one leaf includes an opening with vertically opposed cushioned shoes slidably supporting an elongate lock bar reciprocative lengthwise in a direction along the length of the drawbridge. A receiver housing mounted at the tip of the other leaf is positioned to interlock with the guide housing and includes a like opening slidably receiving the lock bar between vertically opposed cushioned shoes. A pair of vertical guide columns project from both side of the guide housing opening with the upper and lower edges of the distal sides beveled inwardly, and another pair of vertical guide columns project from both side of the receiver housing opening with the upper and lower edges of the proximal sides beveled outwardly. Within a specified maximum limit of misalignment, the guide and receiver columns interengage causing their openings to closely align and facilitate insertion of the lock bar into the opening of the receiver housing with limited horizontal bending and shear. The distance between the proximal sides of the receiver housing exceeds the distance between the distal sides of the guide housing by an amount corresponding to the specified maximum misalignment for a particular bridge design. The housings are secured to the bridge trusses by vertical columns of bolts and the cushioned shoes are biased by disc springs mounted on guide pins.

8 Claims, 7 Drawing Sheets

SPAN LOCK WITH CENTERING GUIDE

RELATED APPLICATIONS

This application claims priority under 35 U.S.C. §120 to U.S. Provisional Application Serial No. 60/341,509 filed on Dec. 12, 2001 and to U.S. Provisional Application Serial No. 60/367,997 filed on Mar. 26, 2002.

BACKGROUND OF THE INVENTION

The present invention relates generally to span lock systems for single and double leaf drawbridges; and more particularly to a novel and improved span lock centering guide and mounting in a single or double leaf drawbridge.

Span lock systems, in addition to securing the leafs of a drawbridge in the closed position, also provide for vertical shear load transfer between their outer ends whereby the leaf tips deflect uniformly during passage of vehicular traffic. U.S. Pat. No. 5,327,605 to Robert L. Cragg discloses such a system in which a rectangular lock bar, retractable parallel to the drawbridge span length, fits through a guide mounted on a rectangular base on the outer end of one leaf of the bridge and into a receiver mounted on a rectangular base on the outer end of the other leaf. The bases are secure to the bridge structure by bolts which are spaced apart along the top and bottom edges of both bases, and along the edge of the receiver base away from the outer leaf end. Stiff annular springs are vertically supported by guide pins which are fixed to the wear shoes with sliding clearance in the guide and receiver, respectively. The springs urge the wear shoes in firm and continuous contact against the lock bar. The top and bottom surfaces of the lock bar and the shoes at their confronting outer ends are beveled to accommodate slight vertical misalignments between the guide and receiver during insertion of the lock bar. In a fully locked position, vertical shock loads to the bar from road traffic are cushioned by the springs, and uncontrolled bounce of the leaf ends is eliminated. The sides at the outer ends of the lock bar are also beveled to accommodate slight lateral misalignments, but there are no provisions for limiting shear stresses in the lock bar from more severe lateral misalignments as may occur due to wind, thermal expansion, uneven wear, uneven settlement of bridge structure, or marine vessel collision.

While the span lock system of U.S. Pat. No. 5,327,605 has distinct advantages over prior art designs for cushioning vertical shock loading, it does not limit horizontal bending and shear stresses in the lock bar due to substantial lateral misalignment of the span leaf locking elements as may occur due to side winds, thermal expansion or contraction, uneven settlement of bridge structure, or marine vessel collision.

U.S. Pat. No. 2,610,341 to Gilbert discloses a span lock system with means for horizontally aligning the leafs of a double leaf bascule bridge but does not limit horizontal bending or shear stress in the lock bar lock. A slotted alignment disc is loosely rotatable within a male member at the tip of one leaf. A lock bar reciprocates lengthwise on an axis normal to the bridge span in a receiving member at the tip of the adjoining leaf includes and engages the slotted disc. The receiving member includes a vertical slot slightly flared at the upper and lower ends for capturing the male member and laterally positioning the alignment disc along the length of the lock bar.

SUMMARY OF THE INVENTION

Accordingly, it is an object of the present invention to provide a centering guide for a span lock system in a single or double leaf drawbridge which will limit horizontal misalignment of the locking components.

Another object of the invention is to limit the horizontal stresses transferred to the lock bar in a span lock system as may occur due to strong side winds, thermal expansion or contraction, uneven wear of bridge components, or uneven settlement of bridge structure.

Another object of the present invention to provide a mounting for a span lock with a centering guide in a single or double leaf drawbridge which will maximize the ability of the wear shoes to accept misalignments of the wear shoes experienced during passage of heavy traffic on the bridge leafs.

Still another object of the invention is to provide a centering guide for aligning locking components in span lock system which is of relatively simple design for facilitating ease of manufacture, maintenance, repair and replacement of parts.

These and other objects and advantages of the invention are accomplished by a span lock centering guide and mounting in a drawbridge. A guide housing mounted on either side by two columns of bolts to the outer end of one leaf of the bridge includes an opening with vertically opposed cushioned wear shoes slidably supporting an elongate lock bar reciprocative lengthwise in a direction along the length of the drawbridge. A receiver housing mounted by two columns of bolts to the outer end of the other leaf is positioned to interlock with the guide housing and includes a like opening slidably receiving the lock bar between vertically opposed cushioned wear shoes. A pair of springs, spaced apart along the length of the lock bar, in each housing, urge the shoes in continuous contact with the upper and lower surfaces for reducing shock loads and eliminate bounce of the leaf ends. Each spring comprises a stack of coaxial Belleville discs retained by a cylindrical guide pin fixed to the wear shoes and is slidable in the housings. The center lines of the guide pins are parallel to and substantially between the center lines of the bolt columns. A pair of vertical guide columns project from either side of the guide housings opening with the upper and lower ends of the distal sides tapering inwardly, and another pair of vertical guide columns project from the on either side of the receiver housing opening with the upper and lower end of the proximal sides tapering outwardly. Within a specified maximum limit of misalignment, the guide and receiver columns interengage causing their openings to closely align and facilitate insertion of the lock bar into the opening of the receiver housing with limited horizontal bending and shear. The distance between the proximal sides of the receiver housing exceeds the distance between the distal sides of the guide housing for specified maximum misalignment.

BRIEF DESCRIPTION OF THE DRAWINGS

For a more complete understanding and appreciation of the invention and its many attendant advantages, reference will be made to the following detailed description taken in conjunction with the accompanying drawings wherein.

DESCRIPTION OF THE PREFERRED EMBODIMENT

Figure 1:
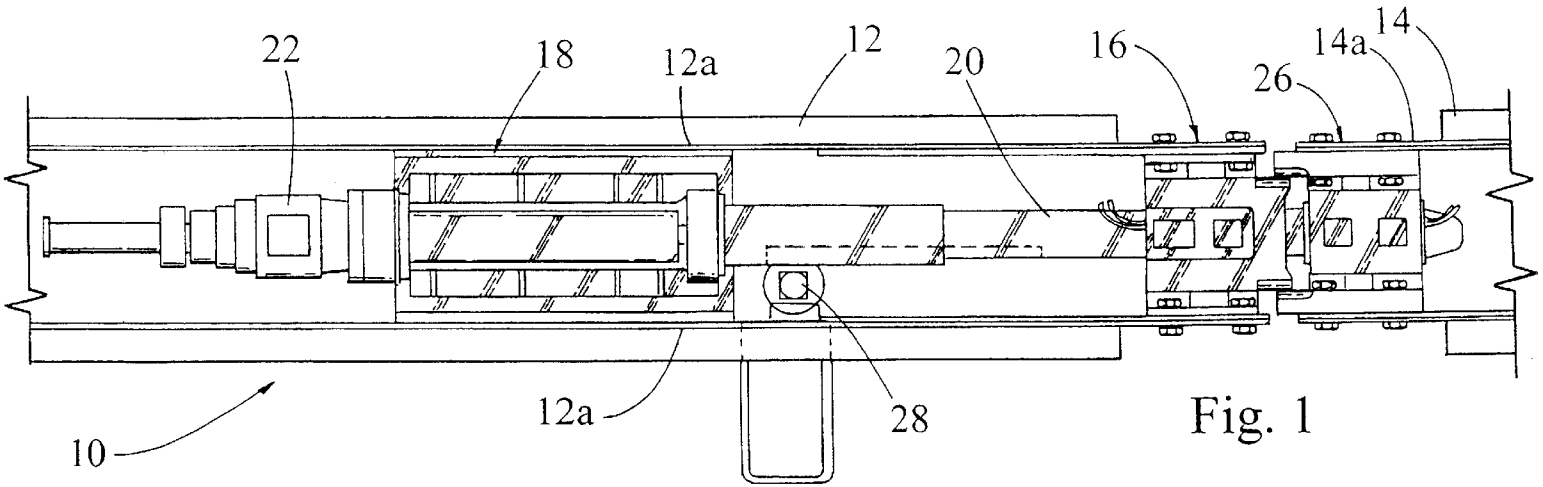
FIG. 1 is a plan view of a span lock system as applied to a double leaf bascule bridge locked in the closed position having a centering guide according to the invention.
Figure 2:
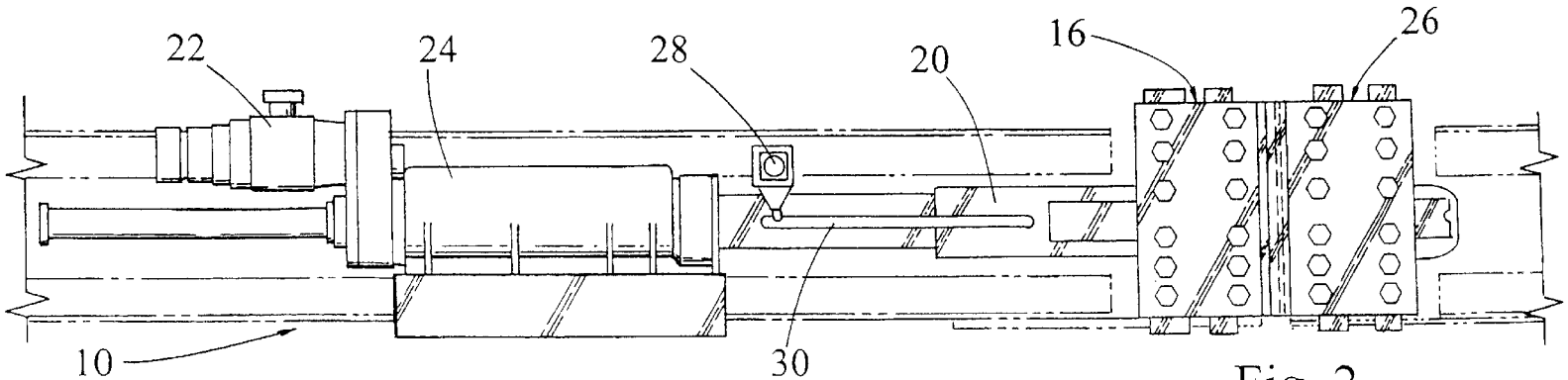
FIG. 2 is an elevation view of the span lock system of FIG. 1 with supporting bridge structure shown in broken outline.
Figure 3:
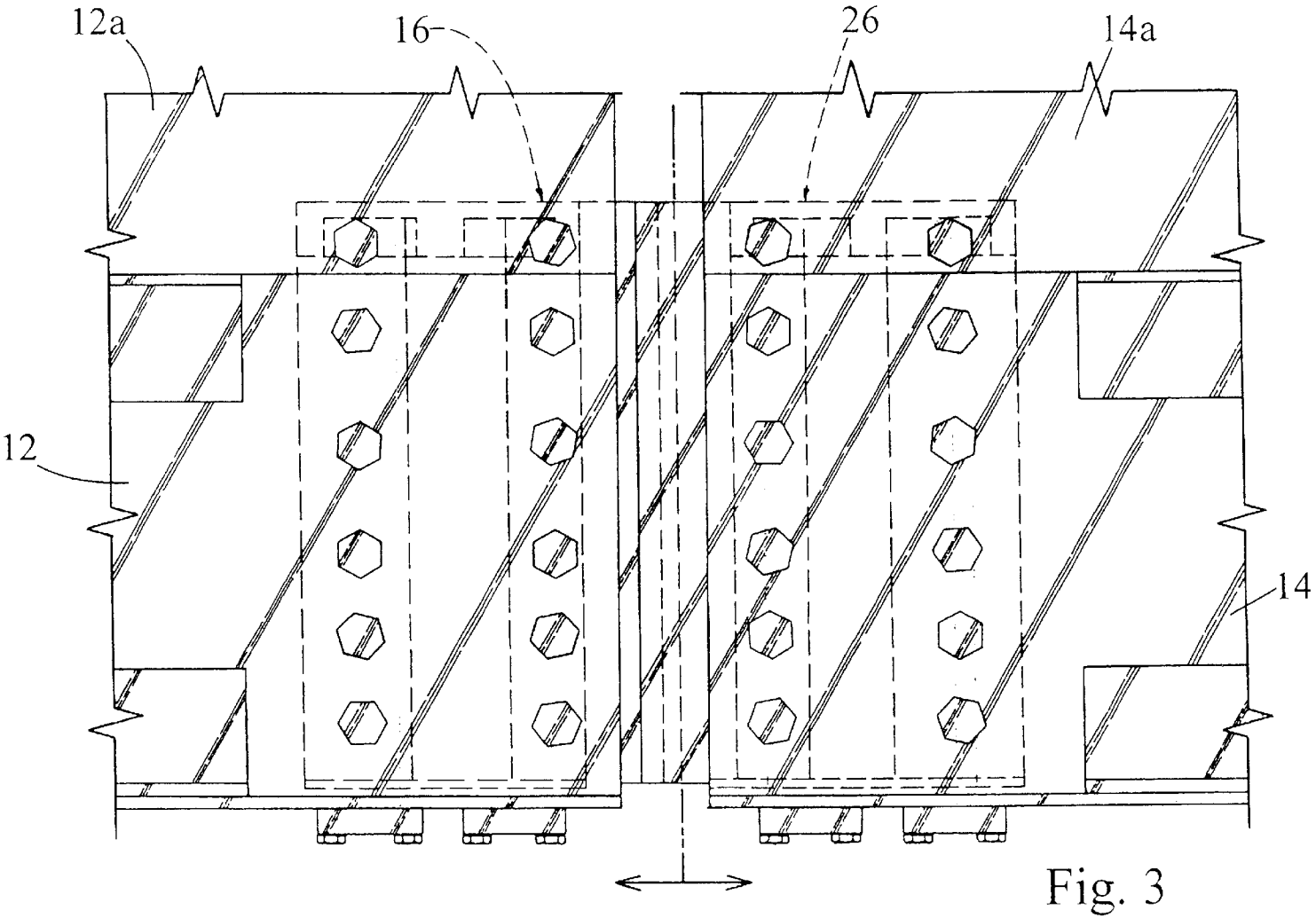
FIG. 3 is a larger elevation view of the outer end of the span lock system of FIG. 2, partially in broken outline, with supporting bridge structure.

Referring now to the drawings wherein like reference characters and numbers denote like or corresponding parts throughout the several views, a span lock system with a novel centering guide according to the invention, is represented generally by the numeral 10 in FIGS. 1 and 2, and comprises a guide housing 16 and a receiver housing 26 mounted, respectively, in box trusses 12 and 14 at the facing tips of a double-leaf drawbridge, shown in the closed and locked position. A lock bar assembly 18 mounted on truss 12 includes a motor 22 and gear train 24 for reciprocating a lock bar 20 through guide housing 16 lengthwise and parallel to the bridge span length. A travel limit member 28 is operatively connected to a slot 30 in lock bar 20 and functions to limit the travel of lock bar 20 in either direction. In the bridge closed position, guide housing 16 and receiver housing 26 are aligned to receive an extended portion of lock bar 20 and to lock the bridge leafs in place. It will be appreciated that the system is applicable to other forms of drawbridges such as a single-leaf span where the movable leaf end connects to stationary structure.

Figure 6:
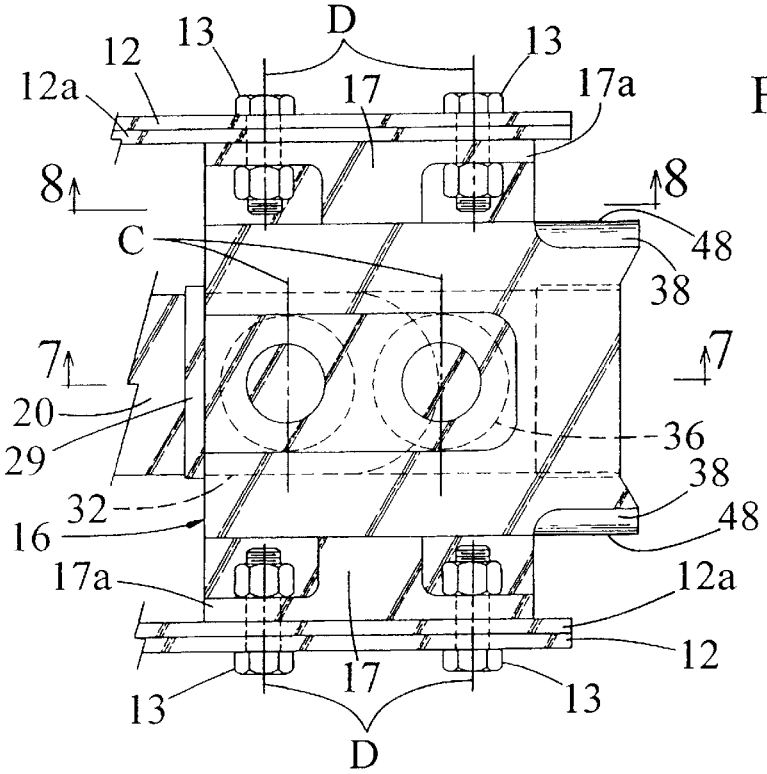
FIG. 6 is a plan view of the bar guide assembly with supporting bridge structure.
Figure 8:
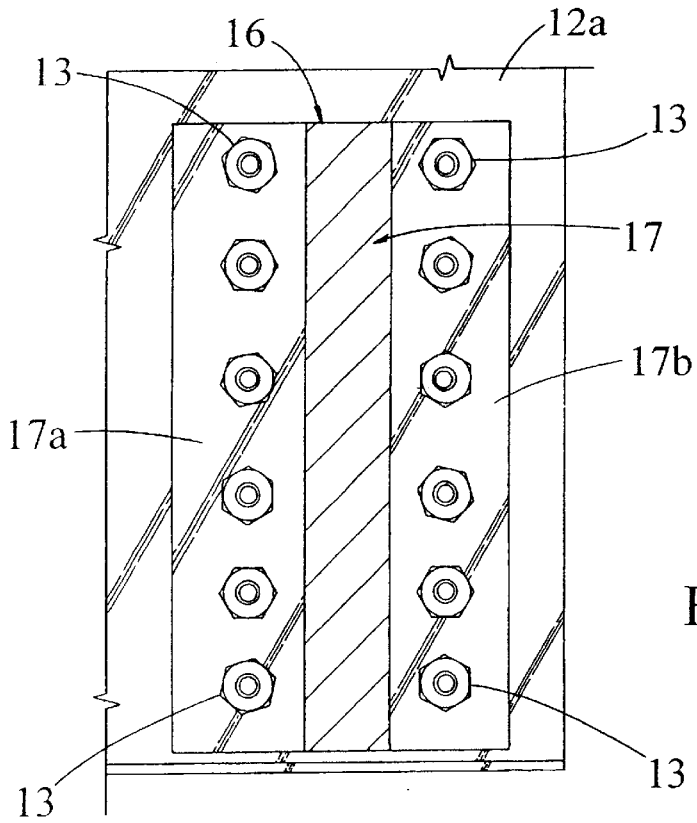
FIG. 8 is an elevation view of the bar guide assembly and supporting structure taken in cross section in a plane along the line 8—8 of FIG. 6.
Figure 11:
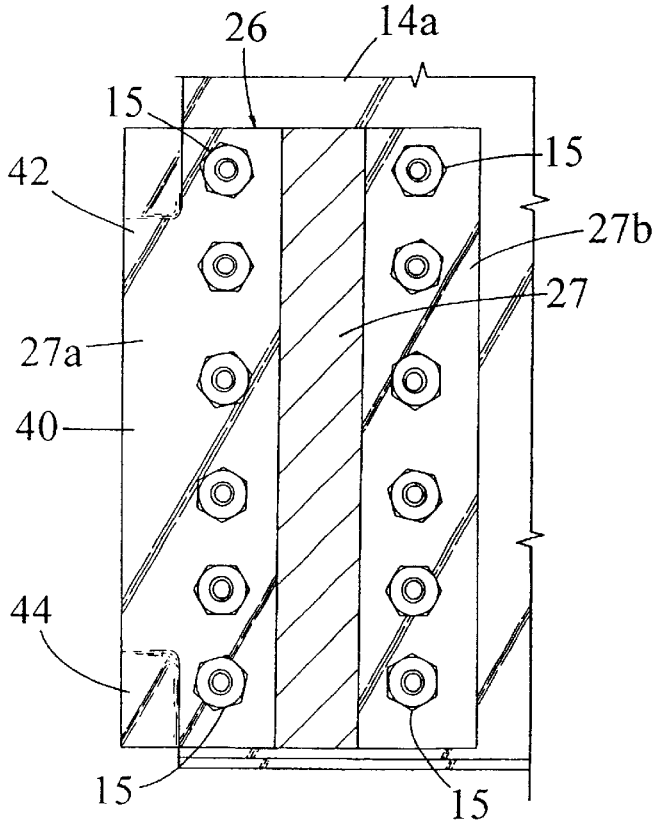
FIG. 11 is an elevation view of the bar receiver assembly and supporting structure taken in cross section in a plane along the line 11—11 of FIG. 9.
Figure 9:
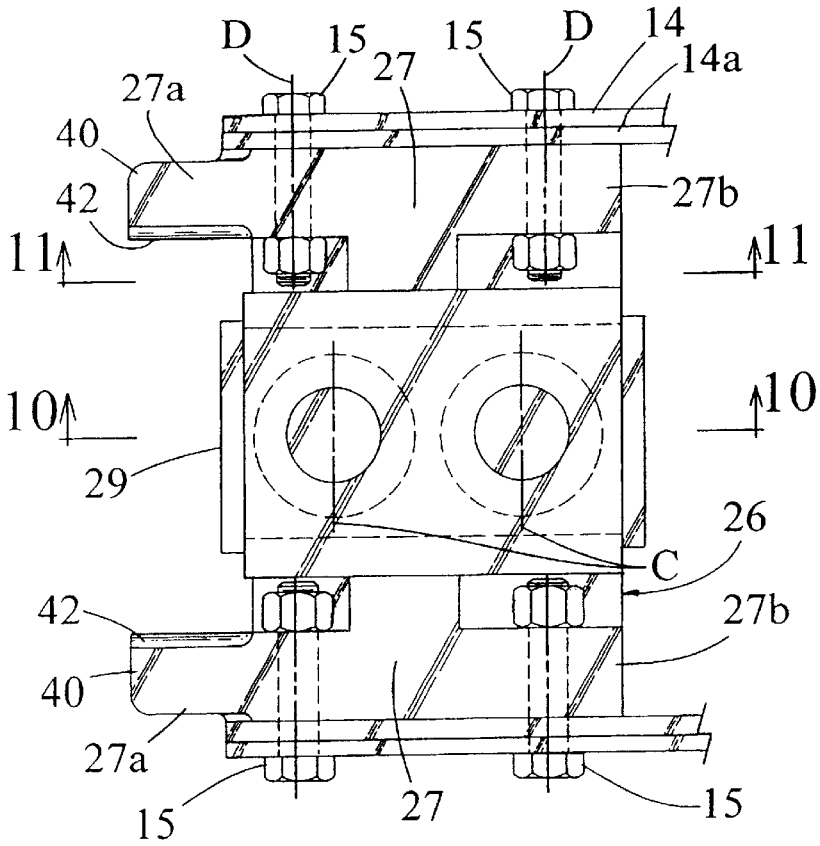
FIG. 9 is plan view of the bar receiver assembly with supporting bridge structure.

Elongate stiffeners 17 (FIGS. 6 and 8) extend from opposite sides of housing 16 in a plane normal to the length of lock bar 20 and terminate in opposed lateral flanges 17*a*. Stiffeners 17 could be formed integral with housing 16, or as a separate element that is connected to housing 16. A column of bolts 13 in each flange 17*a*, aligned in parallel to stiffeners 17, function to secure guide housing 16 to box truss 12 and gusset plates 12*a*. Similarly, receiver housing 26 includes stiffeners 27 with opposed flanges 27*a* and 27*b* (FIGS. 9 and 11) secured to the sides of box truss 14 and gusset plates 14*a* by a columns of bolts 15 aligned in parallel with stiffeners 27.

Figure 7:
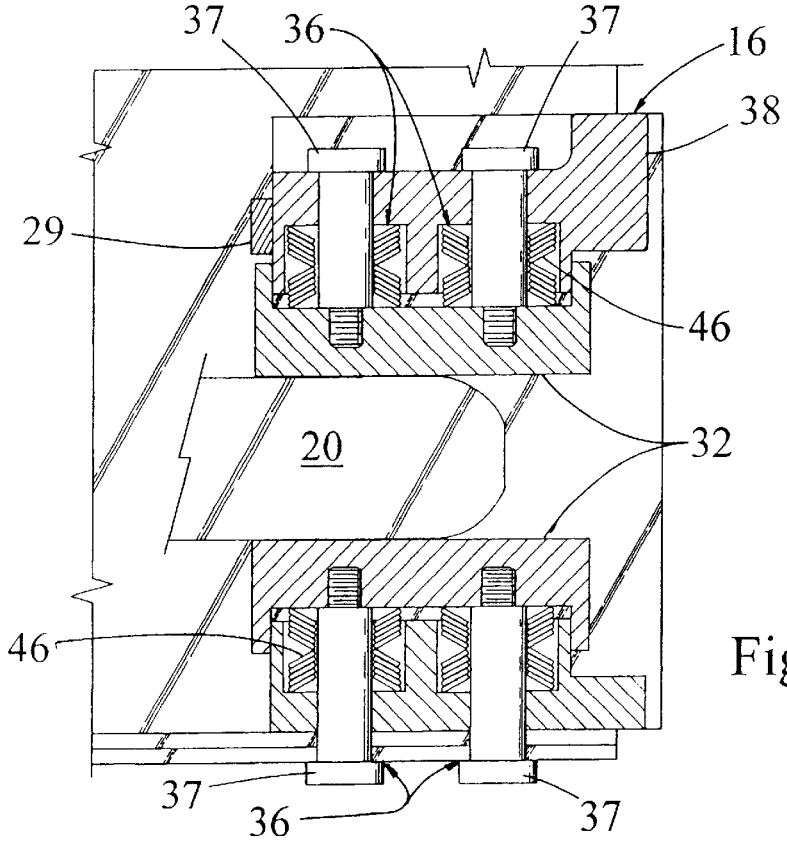
FIG. 7 is an elevation view of the bar guide assembly with supporting structure taken in partial cross section in a plane along the line 7—7 of FIG. 6.
Figure 10:
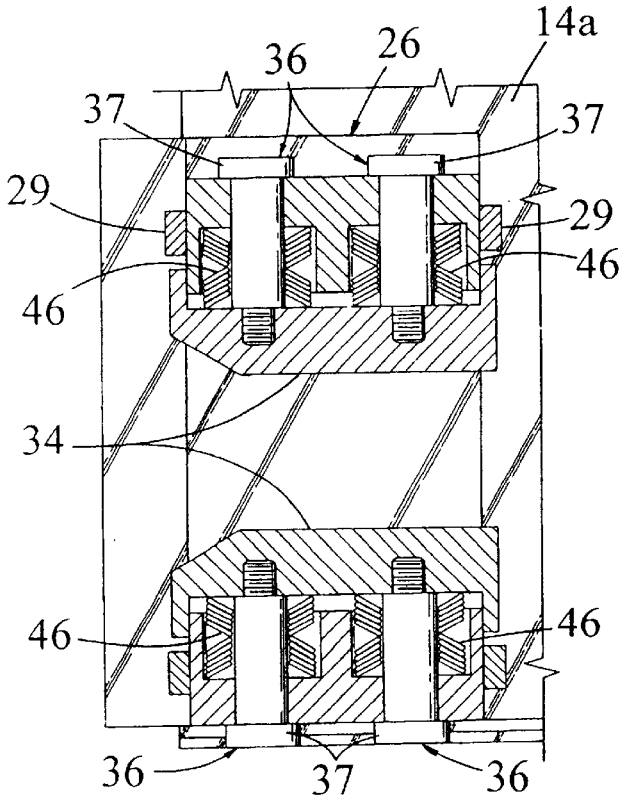
FIG. 10 is an elevation view of the bar receiver assembly and supporting structure taken in partial cross section in a plane along the line 10—10 of FIG. 9.

The portion of lock bar 20 extending through housings 16 and 26 is generally rectangular in cross section, and is slidable between movable upper and lower wear shoes 32 within housing 16 (FIG. 7), and between movable upper and lower wear shoes 34 within housing 26 (FIG. 10). Pairs of upper and lower springs 36, spaced apart along the length of lock bar 20 in each housing, urge the shoes 32 and 34 into continuous contact with the upper and lower surfaces of lock bar 20 for reducing shock loads and eliminating bounce of the leaf ends. Each spring 36 comprises a stack of coaxial Belleville discs 46 retained by a cylindrical guide pin 37 fixed to wear shoes 32 and 34 and slidable in housings 16 and 26, respectively. The center lines C of guide pins 37 are disposed parallel to and substantially between the center lines D of the columns of bolts 13 and 15. The sliding clearance allowed between the guide pins and the housings, together with positioning the pins between the bolts, maximizes the ability for the wear shoes to accept misalignments of the wear shoes experienced during passage of heavy traffic on the bridge leafs, and minimizes the shear loads on the mounting bolts.

Figure 5:
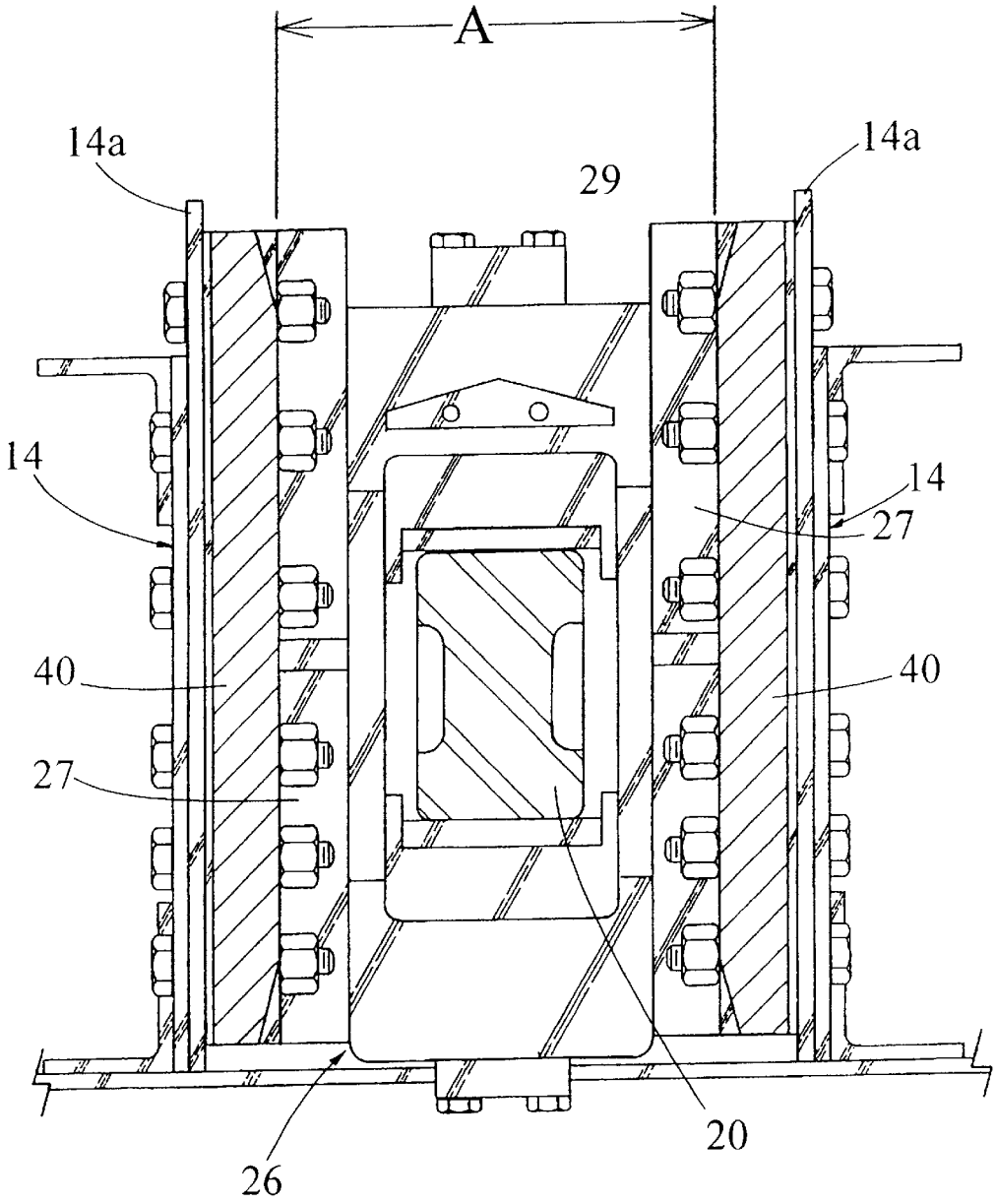
FIG. 5 is an end view of a bar receiver assembly according to the invention with the lock bar in cross section, taken in a plane along the line 5—5 of FIG. 3.

A guard 29 (FIGS. 6 and 7) projects from guide housing 16 above and adjacent to the inlet end of upper wear shoe 32 to deflect any fluids or debris from gathering within proximity of the lock bar-shoe interface. Guards 29 (FIGS. 5, 9, 10) similarly project from receiver housing 26 above and adjacent to both ends of upper wear shoe 34.

The upper and lower surfaces at the ends of lock bar 20 (FIGS. 2 and 7) and the corresponding meeting ends of wear shoes 34 (FIG. 10) in receiver housing 26 are tapered to enable initial capture of lock bar 20 in receiver housing 26 when there is any small amount of vertical misalignment as the bridge leafs meet. As lock bar 20 is inserted between wear shoes 34, housings 16 and 26 are aligned vertically between their respective wear shoes 32 and 34 when the forces of springs 36 are counterbalanced in a static position. Springs 36 are designed with sufficient stiffness to accommodate displacement from the static position under maximum anticipated vertical shock loadings.

Figure 4:
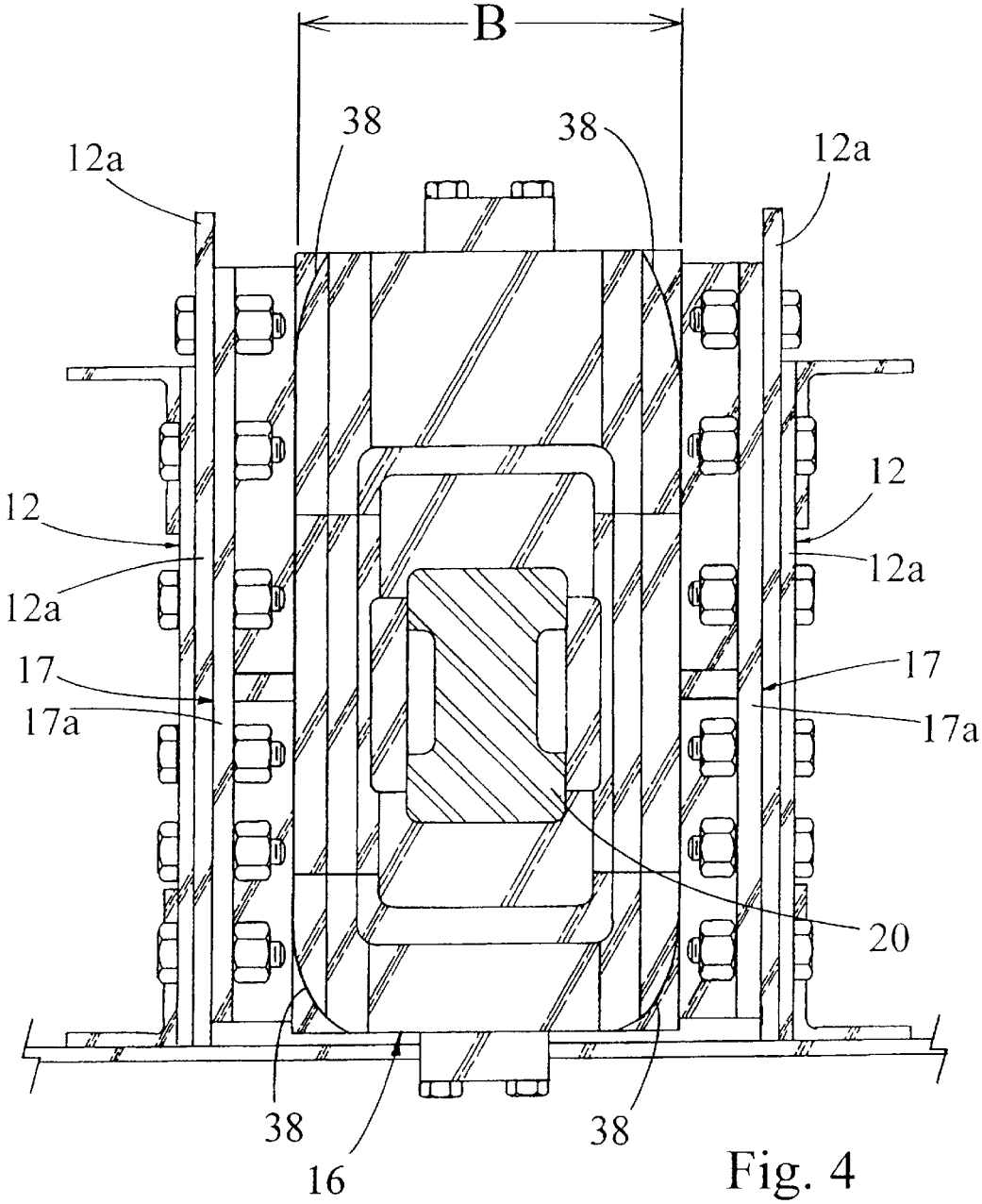
FIG. 4 is an end view of a bar guide assembly according to the invention with a lock bar in cross section taken in a plane along the line 4—4 of FIG. 3.

The side surfaces at the ends of lock bar 20 (FIG. 1) are also tapered to enable lock bar 20 to be captured in receiver housing 26 with limited horizontal bending or shear when there is only a small amount of horizontal displacement between of housings 16 and 26. More substantial horizontal displacements are adjusted by complementary pairs of guide and receiver columns 38 and 40 projecting respectively from the confronting ends of guide and receiving housings 16 and 26 in amounts sufficient to insure they fully overlap and intermesh as the bridge leafs close. Guide columns 38 have parallel distal sides 48 disposed on opposite sides of the guide housing opening and the upper and lower edges of the distal sides 48 are beveled. Receiver columns 40 have parallel proximal sides 42 disposed on opposite sides of the receiver housing opening with the upper and lower edges of the proximal sides 42 beveled. The distance A (see FIG. 5) between the proximal sides 42 of receiver housing 26 exceeds the distance B (see FIG. 4) between the distal sides 48 of guide housing 16 by an amount corresponding to the maximum allowed horizontal displacement for a specified application. Thus, as the bridge leafs near closure, any horizontal bending or stress resulting in the misalignment of housings 16 and 26 that is less than the difference A-B is corrected and the housings 16 and 26 are moved into closer alignment as a result of the sliding engagement of guide columns 38 and receiver columns 40. As a result of this initial alignment of housings 16 and 26 by guide columns 38 and receiver columns 40 when the lock bar 20 is moved by the motor 22 and gear train 24 through the housings 16 and 26, lock bar 20 need only complete or fine tune the alignment. In an actual construction of housings 16 and 26, for example, the distance A between the proximal sides 42 of columns 40 is 14¾ inches, and distance B between the distal sides 48 of columns 38 is 14⅛ inches. This allows housings 16 and 26 to be aligned from a maximum horizontal misalignment of ⅝ of an inch. The lock bar 20 is capable of reducing the horizontal misalignment to less than ⅝ of an inch.

It will be understood, of course, that various changes in the details, materials, and arrangement of parts, which have been herein described and illustrated in order to explain the nature of the invention, may be made by those skilled in the art within the principles and scope of the invention.

What is claimed is:

1. A centering guide for a drawbridge having at least one movable leaf, a guide housing having an opening with vertically opposed cushioned shoes mounted near the outer end of said leaf, an elongate lock bar reciprocative between the shoes in a direction parallel to the span of the drawbridge, and a receiver housing having an opening with vertically opposed cushioned shoes mounted on another leaf of the drawbridge facing the guide housing when the drawbridge is closed, said centering guide comprising:

a first pair of vertical columns projecting from the guide housing on opposite sides of the opening thereof; and a second pair of vertical columns projecting from the receiver housing on opposite sides of the opening thereof; the distance between said proximal sides of said second pair of columns exceeds the distance between said distal sides of said first pair of columns by an amount corresponding to a specified maximum horizontal misalignment.

2. The centering guide apparatus according to claim 1 wherein:

the upper and lower edges of said first pair of columns are beveled on their distal sides; and said upper and lower edges of said second pair of columns are beveled on their proximal sides for initially capturing said first pair of columns as the drawbridge nears full closure.

3. A span lock system for drawbridges having at least one movable leaf, said system comprising, in combination:

a guide housing having an opening with vertically opposed cushioned shoes mounted near the tip of said leaf;

an elongate lock bar slidably extendable between said shoes in a direction parallel to the span of the drawbridge;

a receiver housing having an opening with vertically opposed cushioned shoes mounted on another leaf of the drawbridge facing the guide housing when the drawbridge is closed;

a first pair of vertical columns projecting from said guide housing on opposite sides of the opening thereof; and a second pair of vertical columns projecting from said receiver housing on opposite sides of the opening thereof for capturing said first pair of vertical columns when the drawbridge nears closure; the distance between the proximal sides of said second pair of columns exceeds the distance between the distal sides of said first pair of columns a predetermined specified maximum misalignment.

4. The span lock system according to claim 3 wherein:

said upper and lower edges of said first pair of columns are beveled on their distal sides; and said upper and lower edges of said second pair of columns are beveled on their proximal sides for initially capturing said first pair of columns as the drawbridge nears full closure.

5. For use in a drawbridge having an elongate member axially movable along the length of the drawbridge span for interlocking adjoining leafs, an alignment apparatus comprising:

a first housing formed to be mounted on the tip of a first leaf with a first opening for slidably supporting said elongate member;

a second housing formed to be mounted on a second leaf and facing said first housing and with a second opening for slidably receiving said elongate member; and operatively interlocking facing surfaces of said first and second housings for horizontally aligning said openings.

6. The alignment apparatus according to claim 5 wherein said interlocking means comprises:

a first pair of vertical elements projecting from said first housing opening on opposite sides of said first opening; and a second pair of vertical elements projecting from said second housing on opposite sides of said second openings for registering with said first pair of vertical elements.

7. The alignment apparatus according to claim 6 wherein said first pair of vertical elements are beveled at the upper and lower ends of their distal sides; and said second pair of elements are beveled at the upper and lower ends of their proximal sides for capturing said first pair of elements as the drawbridge closes.

8. The alignment apparatus according to claim 7 wherein the distance between the proximal sides of said second pair of elements exceeds the distance between the distal sides of said first pair of elements by an amount determined for a specified maximum misalignment of said housing openings.

* * * * *